United States Patent [19]

Rhode

[11] Patent Number: 4,964,901

[45] Date of Patent: Oct. 23, 1990

[54] LOW-TEMPERATURE SEPARATION OF AIR USING HIGH AND LOW PRESSURE AIR FEEDSTREAMS

[75] Inventor: Wilhelm Rhode, Munich, Fed. Rep. of Germany

[73] Assignee: Linde Aktiengesellschaft, Wiesbaden, Fed. Rep. of Germany

[21] Appl. No.: 354,257

[22] Filed: May 19, 1989

[30] Foreign Application Priority Data

May 20, 1988 [DE] Fed. Rep. of Germany ..... 3817244

[51] Int. Cl.[5] ..... F25J 5/00

[52] U.S. Cl. ..... 62/13; 62/23; 62/43

[58] Field of Search ..... 62/9, 11, 13, 23, 43

[56] References Cited

U.S. PATENT DOCUMENTS

| | | | |
|---|---|---|---|
| 2,666,303 | 1/1954 | Schuftan | 62/43 |
| 2,846,853 | 8/1958 | Matsch | 62/43 |
| 2,873,583 | 2/1959 | Potts et al. | 62/43 |
| 2,915,882 | 12/1959 | Schuftan et al. | 62/43 |
| 3,280,574 | 10/1966 | Becker | 62/13 |
| 3,500,651 | 3/1970 | Becker | 62/13 |
| 3,699,695 | 10/1972 | Becker | 62/13 |
| 3,760,596 | 9/1973 | Basin et al. | 62/13 |
| 4,704,147 | 11/1987 | Kleinberg | 62/43 |
| 4,731,102 | 3/1988 | Yoshino | 62/11 |

FOREIGN PATENT DOCUMENTS

| | | |
|---|---|---|
| 3643359 | 12/1986 | Fed. Rep. of Germany . |
| 2180923 | 6/1986 | United Kingdom . |

*Primary Examiner*—Ronald C. Capossela

*Attorney, Agent, or Firm*—Millen, White & Zelano

[57] ABSTRACT

In the separation of air by a two-stage rectification column, part of the air feedstream is compressed to only the pressure of the low pressure stage and, after prepurification in a molecular sieve and cooling, is fed directly into the low pressure stage.

33 Claims, 1 Drawing Sheet

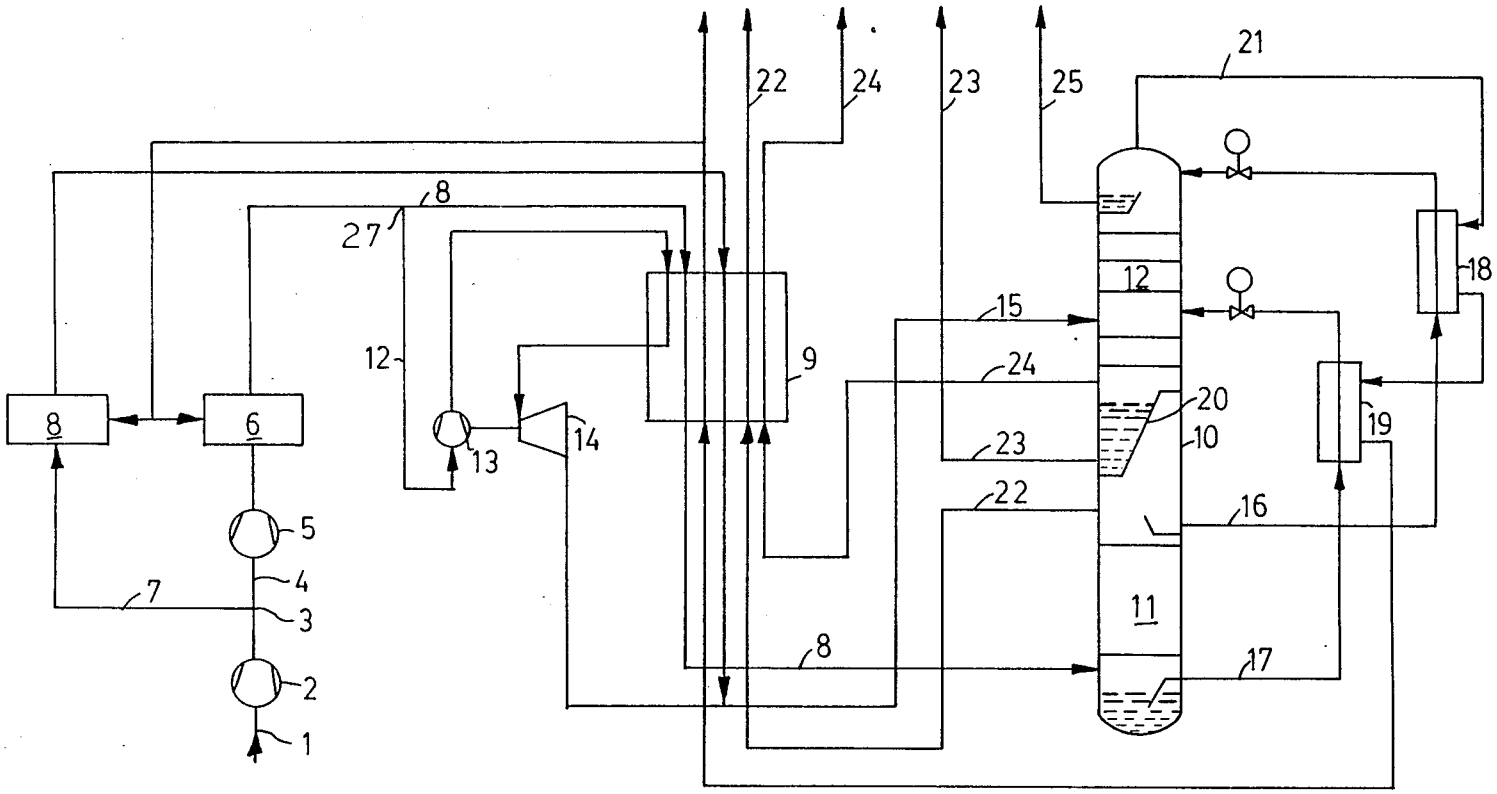
18
19
21
16
17
20
10
12
11
25
15
24
23
22
23
24
9
8
22
14
13
8
27
12
5
4
3
2
1
6
7
8

LOW-TEMPERATURE SEPARATION OF AIR USING HIGH AND LOW PRESSURE AIR FEEDSTREAMS

BACKGROUND OF THE INVENTION

This invention relates to a process and associated apparatus for the low-temperature separation of air in which a first air feedstream is compressed, prepurified, cooled, and at least partially introduced into the high pressure stage of a two-stage rectification system and wherein both gaseous oxygen and gaseous nitrogen are preferably removed from the low pressure stage.

In the separation of air by two-stage rectification, the air feedstream is generally passed into the high pressure stage, where it is preseparated into nitrogen-rich and oxygen-rich fractions which are further rectified in the low pressure stage. In this case, the air feedstream must be compressed to the pressure of the high pressure stage, i.e., to about 5 to 7 bars. Air compressors for this purpose involve high investment and operating costs.

A unit used mainly for the production of oxygen of relatively low purity, for example, lower than 98%, can also be operated so that a part of the air feedstream is passed without preseparation in the high pressure stage directly into the low pressure stage without significantly reducing the oxygen yield. In particular, a process used for recovery of energy from the air feedstream compressed to the pressure of the high pressure column is described in DE-PS No. 28 54 580. In that process, a part of the air feedstream is expanded, after compression, to the pressure level of the low pressure stage and then is fed to the low pressure stage. The refrigeration values recovered during expansion are used for the liquefaction of product gases.

Conversely, in the process of DE-PS No. 28 54 580, the recovery of the compression energy is necessarily incomplete, even with the use of a combination of an expansion turbine and a mechanically coupled compressor. Moreover, the known process lacks flexibility, since the efficient use of expansion turbines is limited to a relatively narrow range of rates of flow. Thus, the amount of air passed directly into the low pressure stage can be changed to only a limited extent during operation.

SUMMARY OF THE INVENTION

An object of one aspect of the invention is to develop a process of the type described above, which is economically more efficient.

An object of another aspect of the invention is to provide apparatus for such a process.

Upon further study of the specification and appended claims, further objects and advantages of this invention will become apparent to those skilled in the art.

To achieve the process aspect of the invention, a process is provided comprising compressing a second air feedstream to a pressure lower than the first air feedstream and passing the second air feedstream into the low pressure stage of the rectification column. In general, there are also provided intermediate steps of prepurifying and cooling the compressed second air feedstream before entering the low pressure stage; however, such steps, e.g., prepurification, could be conducted beforehand.

At least part, e.g., generally 20 to 80%, of the air passed directly into the low pressure stage is compressed to only the pressure of the low pressure stage of 1.3 to 2.5 bars, preferably 1.5 to 1.8 bars. In this way, from the very start of the process, less energy is required to compress the total air feedstream, and additional equipment is not required to recover excess compression energy. Another advantage of the process according to the invention is that the amount of air introduced directly into the low pressure column can be adjusted over very wide ranges. Thus, depending on the desired purity of the oxygen product, the amount of air introduced directly into the low pressure column can be easily varied without significantly influencing the oxygen yield. Accordingly, using the process of the present invention, for example, with the aid of simple conventional controllers, the throughput of the second air feedstream can be increased if the purity requirements of the oxygen product are lowered.

In a preferred embodiment of the process according to the invention, the total air feedstream is compressed together in a first compression stage to the pressure of the low pressure stage and then separated into said first and second air feedstreams. The first air feedstream is then further compressed in a second compression stage to the pressure of the high pressure stage. This means that no specific compressor is required for the second air feedstream, resulting in a lower investment. The two stages of the compression can each consist of several individual compressor units.

According to an advantageous feature of the invention, after prepurification of the first air feedstream at the pressure of the high pressure column, a partial stream, e.g., about 10 to 30, preferably 15 to 19% is branched off, further compressed to about 6 to 9 bars, cooled, and work expanded. By this work expansion of the partial stream, the required refrigeration values can be generated, not only for compensating for general refrigeration losses such as insulation and heat exchange losses, but also for the liquefaction of product gases.

In accordance with a further advantageous feature, the work recovered during expansion of the partial stream of the first air feedstream is used for compression of the partial stream.

In a still further advantageous development of the invention, said partial stream is work expanded to the pressure of the low pressure column and is introduced, after expansion, into the low pressure stage of the rectification apparatus. Because the partial stream is expanded to the lower pressure of the low pressure stage, a high enthalpy difference is available, which is particularly beneficial for the generation of refrigeration values.

In accordance with the apparatus aspect of the invention, there is provided apparatus comprising a rectification column having a high pressure stage and a low pressure stage, compressor means for compressing an air feedstream to the pressure of the low pressure stage, means for separating said feedstream into a first air feedstream and a second air feedstream, separate compressor means for compressing only said first air feedstream to the pressure of the high pressure stage, means for communicating said second air feedstream to the low pressure stage and means for communicating said first air feedstream to the high pressure stage.

Advantageous further features of the apparatus coincide with the apparatus required for conducting the above process or which are described in the attached drawing.

BRIEF DESCRIPTION OF THE DRAWING

Various other objects, features, and attendant advantages of the present invention will be more fully appreciated as the same becomes better understood when considered in conjunction with the accompanying drawing, wherein:

The drawing is a schematic comprehensive preferred embodiment of the invention.

DETAILED DESCRIPTION OF THE DRAWING

By a pipe 1, atmospheric air is taken in by a first compressor stage 2 and is divided at a first branching point 3 into a first air feedstream (pipe 4) and a second air feedstream (pipe 7). The pressure at branching point 3 is 1.3 to 2.5 bars, preferably 1.5 to 1.8 bars. The first air feedstream is further compressed in a second compressor stage 5 and prepurified in a molecular sieve apparatus 6, represented diagrammatically, in which water vapor, carbon dioxide, and hydrocarbons, especially dangerous hydrocarbons, e.g., $C_2H_2$, $C_3H_6$, $C_4H_{10}$, are removed. The pressure in the first air feedstream downstream of the molecular sieve apparatus 6 is 5.0 to 7.0 bars, preferably 5.2 to 6.0 bars. A major portion of the first air feedstream is fed by pipe 8 through a heat exchanger 9, cooled therein countercurrently to the separation products and then passed into the high pressure stage 11 of a two-stage rectification column 10.

At a second branching point 27, a minor partial stream 12 from the first air feedstream is branched off, further compressed in a recompressor 13, cooled in heat exchanger 9, and then expanded in expansion turbine 14 to generate cold. The work recovered during expansion of the partial stream is transferred mechanically to compressor 13. The expanded partial stream is introduced by pipe 15 into low pressure stage 12 of rectification column 10. Low pressure stage 12 is operated at a pressure of 1.1 to 2.0 bars, preferably 1.3 to 1.7 bars and is in indirect heat-exchange relationship with high pressure stage 11 by a condenser-evaporator 20.

Nitrogen-rich liquid 16 and oxygen-rich liquid 17 are removed from high pressure stage 11; these two streams are cooled in heat exchangers 18 or 19 countercurrently to gaseous nitrogen 21 from the low pressure stage 12 and are then, at the appropriate place in each case, throttled to a respective pressure in the low pressure stage 12. As a main product, gaseous oxygen is withdrawn from the low pressure stage 12 by pipe 24, and smaller amounts of liquid oxygen 23 and liquid nitrogen 25 are also removed. Gaseous product streams 21, 22, 24 are heated in heat exchanger 9 to almost ambient temperature. Gaseous nitrogen 21 from the low pressure stage is used partially to regenerate molecular sieve equipment 6, 8. Moreover, a small gaseous, high pressure nitrogen stream can be removed by pipe 22.

The second air feedstream (pipe 7) is prepurified according to the preferred embodiment of the invention in a separate molecular sieve 8, cooled in heat exchanger 9, and then, after being combined by pipe 15 with the expanded partial stream of the first air feedstream, is fed into the low pressure stage 12 of rectification column 10.

The process according to the invention utilizing a direct feed of an air feedstream into the low pressure stage is particularly economically advantageous if the plant is designed to achieve a purity of 85–98% in the oxygen product (pipes 23 and 24 in the embodiment). If, for example, an oxygen purity of 96% is desired, up to 35% of the air feedstream can be fed directly into the low pressure stage without noticeably reducing the oxygen yield. The second compression stage 5 can, corresponding to the lowered required capacity, be designed smaller than that for the first air feedstream; and, during operation, correspondingly less energy can be expended for compression.

As an alternative to the embodiment represented in the figure, instead of the generation of refrigeration by the expansion of partial stream 12 of the first air feedstream, the necessary refrigeration can also be supplied in a different way. In the alternative case, the entire first air feedstream is fed into the high pressure stage and, for example, a part of the first air feedstream is cooled by heat exchange with an external refrigerant. In this embodiment, that part of the feed air which, in the process of the figure is work expanded, need be compressed only to the level of the low pressure stage and the compressor, which corresponds to second compressor stage 5 in the figure, can have a correspondingly smaller size.

It is also possible to feed the second air feedstream completely independently of the first air feedstream in that, by a separate compressor, atmospheric air is taken in only for the second air feedstream.

The above preferred embodiments are to be construed as merely illustrative, and not limitative of the remainder of the disclosure in any way whatsoever.

In the foregoing, all temperatures are set forth uncorrected in degrees Celsius; and, unless otherwise indicated, all parts and percentages are by weight.

The entire texts of all applications, patents, and publications, if any, cited above, and of corresponding Application No. P 38 17 244.5, filed in West Germany on May 20, 1988, are hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A process for the low temperature separation of air comprising passing a compressed, prepurified, and cooled first air feedstream at least partially into a high pressure stage of a two-stage rectification column and passing a second compressed, prepurified, and cooled air feedstream into a low pressure stage of the rectification column, said first air feedstream having been compressed to a higher pressure than the pressure of said second air feedstream entering said low pressure stage.

2. A process according to claim 1, wherein the first and second air feedstreams are compressed in a first stage together and then divided into the two air feedstreams and wherein the first air feedstream is then further compressed in a second compression stage.

3. A process according to claim 2, further the comprising branching from the compressed first air feedstream a partial stream and further compressing, cooling, and work expanding said partial stream.

4. A process according to claim 3, further comprising employing the work recovered during expansion of the partial stream of the first air feedstream for compression of the partial stream.

5. A process according to claim 4, wherein the further compressed partial stream of the first air feedstream is introduced, after expansion, into the low pressure stage of the rectification column.

6. A process according to claim 5 wherein at least one of the compressed, prepurified, and cooled air feedstreams is prepurified and cooled after being compressed and before being passed to the rectification column.

7. A process according to claim 6, wherein the prepurification steps are conducted independently for each air feedstream.

8. A process according to claim 3, wherein the further compressed partial stream of the first air feedstream is introduced, after expansion, into the low pressure stage of the rectification column.

9. A process according to claim 1, further comprising branching from the compressed first air feedstream a partial stream and further compressing, cooling, and work expanding said partial stream.

10. A process according to claim 9, further comprising employing the work recovered during expansion of the partial stream of the first air feedstream for compression of the partial stream.

11. A process according to claim 10, wherein the further compressed partial stream of the first air feedstream is introduced, after expansion, into the low pressure stage of the rectification column.

12. A process according to claim 9, wherein the further compressed partial stream of the first air feedstream is introduced, after expansion, into the low pressure stage of the rectification column.

13. A process according to claim 12, wherein said partial stream of said first air feedstream, after expansion, is combined with said second air feedstream and introduced into said low pressure stage of said rectification column.

14. A process according to claim 9, wherein about 10–30% of said first air feedstream is branched off to form said partial stream.

15. A process according to claim 1, wherein at least one of the compressed, prepurified, and cooled air feedstreams is prepurified and cooled after being compressed and before being passed to the rectification column.

16. A process according to claim 15, wherein the prepurification steps are conducted independently for each air feedstream.

17. A process according to claim 1, wherein an oxygen product is recovered having a purity of 85–98%.

18. A process according to claim 1, wherein said first air feedstream is further compressed to substantially the pressure of said high pressure stage.

19. A process according to claim 1, wherein said second air feedstream is compressed to substantially the pressure of said low pressure stage.

20. A process according to claim 1, wherein during prepurification of said first air feedstream and said second air feedstream, water vapor, $CO_2$, and hydrocarbons are removed therefrom.

21. A process according to claim 1, wherein a gaseous nitrogen stream removed from said low pressure stage is used to regenerate purification stages for prepurifying said first air feedstream and said second air feedstream.

22. A process according to claim 1, wherein said first air feedstream is separately prepurified prior to introduction thereof into the high pressure stage.

23. A process according to claim 1, wherein said second air feedstream is separately prepurified prior to introduction thereof into the low pressure stage.

24. A process according to claim 1, wherein said first air feedstream is separately prepurified prior to introduction thereof to the high pressure stage and said second air feedstream is separately prepurified prior to introduction thereof into the low pressure stage.

25. A process according to claim 1, wherein said first and second air feedstreams are both prepurified by molecular sieve apparatus.

26. An apparatus comprising a rectification column having a high pressure stage and a low pressure stage, means for compressing an air feedstream to the pressure of the low pressure stage, means for separating said feedstream into a first air feedstream and a second air feedstream, separate means for compressing only said first air feedstream to the pressure of the high pressure stage, means for communicating said second air feedstream to the low pressure stage and means for communicating said first air feedstream to the high pressure stage.

27. An apparatus according to claim 26, further comprising a prepurification means for separately prepurifying only said first airstream prior to introduction of said first air feedstream into the high pressure stage.

28. An apparatus according to claim 26, further comprising a prepurification means for separately prepurifying only said second air feedstream prior to introduction of said second air feedstream into the low pressure stage.

29. An apparatus according to claim 26, further comprising a first prepurification means for separately prepurifying only said first air feedstream prior to introduction thereof into the high pressure stage and a second prepurification means for separately prepurifying only said second air feedstream prior to introduction thereof into the low pressure stage.

30. An apparatus according to claim 29, wherein said first prepurification means and said second prepurification means are both molecular sieve apparatus.

31. An apparatus according to claim 26, further comprising branching means for branching off a partial stream from said first air feedstream downstream from said separate means for compressing said first air feedstream.

32. An apparatus according to claim 31, further comprising a compressor means for further compressing said partial stream of said first air feedstream, cooling means for cooling the further compressed partial stream of said first air feedstream, expansion means for expanding the further compressed, cooled partial stream, and means for communicating said expansion means with said low pressure stage so as to deliver the resultant expanded partial stream to said low pressure stage.

33. An apparatus according to claim 32, wherein said compression means and expansion means are mechanically coupled.

* * * * *